US005410327A

United States Patent [19]

Shakun et al.

[11] Patent Number: 5,410,327

[45] Date of Patent: Apr. 25, 1995

[54] SHIPBOARD STABILIZED RADIO ANTENNA MOUNT SYSTEM

[75] Inventors: Wallace Shakun, Atlanta; Richard A. Levy, East point, both of Ga.

[73] Assignee: Crescomm Telecommunications Services, Inc., Miami, Fla.

[21] Appl. No.: 826,017

[22] Filed: Jan. 27, 1992

[51] Int. Cl.[6] ..... H01Q 3/00

[52] U.S. Cl. ..... 343/765; 343/709

[58] Field of Search ..... 343/765, 766, 709, 878, 343/879, 882; 248/125, 183

[56] References Cited

U.S. PATENT DOCUMENTS

| | | | |
|---|---|---|---|
| 3,860,931 | 1/1975 | Pope et al. | 343/765 |
| 3,893,123 | 7/1975 | Bierser | 343/765 |
| 3,968,496 | 7/1976 | Brunvoll | 343/765 |
| 3,999,186 | 12/1976 | Fuss, III | 343/765 |
| 4,020,491 | 4/1977 | Beiser et al. | 343/765 |
| 4,433,337 | 2/1984 | Smith et al. | 343/765 |
| 4,596,989 | 6/1986 | Smith et al. | 343/709 |
| 4,621,266 | 11/1986 | Le Gall et al. | 342/359 |
| 4,803,490 | 2/1989 | Kruger | 342/158 |
| 4,833,932 | 5/1989 | Rogers | 74/343 |
| 4,920,349 | 4/1990 | Le Gall | 343/709 |

*Primary Examiner*—Donald Hajec
*Assistant Examiner*—Tan Ho
*Attorney, Agent, or Firm*—Joel S. Goldman; Scott M. Frank

[57] ABSTRACT

A stabilized antenna mount system is described which includes an antenna subassembly, a means for allowing the subassembly to rotate in three dimensional planes, and a means for stabilizing the subassembly. The subassembly rotates by means of a multi-axis bearing and is stabilized with an inertia mass attached to its lower portion. The inertia mass has a weight approximately six times the combined weight of the subassembly and the multi-axis bearing.

28 Claims, 5 Drawing Sheets

SHIPBOARD STABILIZED RADIO ANTENNA MOUNT SYSTEM

BACKGROUND OF THE INVENTION

This invention relates to a stabilized mount system for radio antennas. More specifically, this invention relates to a purely mechanical stabilization system for mounting radio antennas, such as those used in cellular telephone systems on vehicles such as ships.

Typically, vehicles such as ocean going ships are subjected to motion, such as roll, pitch and yaw, caused, for example, by result of wave motion, gusting winds, and the acceleration, deceleration and turning of the vehicle. Often, a ship may be subject to pitch and roll movements in the order of ±20°, depending on the size of the ship and the loading conditions. Many ocean vessels come equipped with stabilizers to assure that the movement does not exceed ±20°.

In conventional antenna systems (see FIGS. 10 through 13), uniform signals are transmitted from a single source point, with gain and bandwidth being varied to adapt to the application. An ocean vessel antenna system requires high gain to minimize power requirements. Referring to FIG. 11 and FIG. 12 it may be seen that as an antenna's gain increases, the beam width narrows and the allowable limits on the physical orientation of the antenna decrease. Further, as shown in FIG. 13, without a stabilization system, the combination of a narrowed beam width and the roll, pitch, and yaw of a ship can cause a radiated signal from the antenna to intersect the surface of the water or to otherwise reach an undesirable-cell site location. Therefore, an effective antenna stabilization system must compensate for the roll, pitch and yaw of the ship, and also act to decouple the transmission and reception characteristics of the antenna from the movements of the ship.

Many conventional antenna stabilization systems are electronically controlled and/or electrically driven. These systems often include gyroscopes, servomotors, microprocessors, and various forms of feedback circuits. Commonly, stabilization devices use gyros in combination with multi-access integrators, in order to stabilize a platform system. The passive stabilization system is further controlled by a feedback loop, which interacts with motors to assure that the system is continuously stable by moving the gyro and pendulum weight as needed. Other devices make similar use of the electronic controls, but use a pendulum connected to a spring or a ring mounted for rotation on a radome. These systems also make use of a feedback loop and motors to stabilize the system.

U.S. Pat. No. 3,968,496 to Brunvoll describes a purely mechanical stabilization system which incorporates a counterweight supported in a universal joint bearing. The system includes an elevational and azimuth controller mounted to a platform with a shaft, which is supported by the universal joint bearing. This system makes use of a small mass system, which incorporates a container enclosing two curved tubes which may be filled with liquid and/or small balls. The mass system is mechanically coupled to the platform shaft and is used to stabilize and/or damp the movements of the antenna caused by a ship. The Brunvoll invention includes a servo motor and a momentum wheel driven by a motor as possible accessories to improve the stabilization of the system. Due to the construction of this invention, it is believed to be expensive to produce and subject to high maintenance.

Systems using gyros and/or electronic feedback loops are often quite expensive to manufacture and incur high field service and maintenance costs. A passive mechanical system could significantly reduce costs if adequate stabilization means could be obtained. Previously, designers of mechanical systems have had difficulties designing a system which provides adequate damping to reduce the possibility of oscillation, while at the same time providing adequate decoupling of the antenna from the ship's motion so as to meet the accuracy needs of the radio transmission system.

SUMMARY OF THE INVENTION

Accordingly, it is an object of this invention to provide a fully mechanical antenna stabilization system for modes of transportation that has no need for a gyroscope or for electronic peripheral equipment.

It is yet another object of this invention to provide a fully mechanical antenna stabilization system which has an assembly that is fully self contained on one platform.

It is still another object of this invention to provide a fully mechanical antenna stabilization system which has one moving multi-axis stabilization component.

It is another object of this invention to provide a fully mechanical antenna stabilization system for vehicles that incorporates one mechanical attachment as a means of securing the system to the vehicle's structure.

It is still a further object of this invention to provide a fully mechanical antenna stabilization system for more than one antenna.

These and other objects are achieved by the antenna stabilization system of the present invention. In a preferred embodiment, the system includes four main components: a subassembly housing, a multi-axis bearing, an inertia mass, and a structural support fixture. The multi-axis bearing may be connected to the subassembly housing by a suitable means, such as a bolt; the structural support fixture is secured to the multi-axis bearing shaft by suitable means, such as a nut; and the inertia mass may be attached to the antenna housing with a strong adhesive, such as an epoxy.

The subassembly housing includes three main components: an interior housing, an exterior housing, and a ferrule. The antenna is encapsulated in a fiberglass interior housing with a ferrule mounted to the top of the interior housing. A transceiver cable attached to the antenna protrudes through a hole in the ferrule. This hole is insulated around the cable to assure that the antenna is adequately protected from the elements. Both the interior housing and the ferrule are surrounded by a hard plastic cylindrical exterior housing. The exterior housing has a cable spline cutout, which allows the transceiver cable to be connected directly to the antenna through the ferrule. The ferrule and the exterior housing have at least one locking pin hole which are aligned to allow for a locking pin to be inserted. The locking pin acts as a safety mechanism to assure that the system will remain securely in place by locking the ferrule and the exterior housing together. Further, it provides a means for the weight of the system to be transferred away from the fiberglass interior housing to the ferrule and the exterior housing.

The multi-axis bearing has a socket, with a hole through its center, on one of its ends and a threaded shaft on the other end. The socket contains a spherical structure, such as a metal ball, that has its top and bottom cut off, and has a hole through its center. A bolt passing through the hole in the socket and the spherical object may be used to attach the multi-axis bearing to the interior threading in the top of the ferrule.

The structural support fixture is crimped at right angles and has one hole through a center portion to accommodate the multi-axis bearing shaft. It also has at least one hole in its top end and at least one hole in its bottom end, which allows the structural support fixture to be secured to the surface of a structure. The threaded shaft on the multi-axis bearing allows the structural support fixture to be slid on to it and secured into place by suitable means, such as a nut. A set screw in the side of the nut my be used to level the system.

The inertia mass is preferably made of metal and is encapsulated in a protective plastic housing. It has one hole in its top, which allows the antenna housing to be inserted into place and secured within it.

When the system is completely assembled and mounted, the subassembly housing hangs from the multi-axis bearing. As the vehicle rolls, pitches, or yaws, the freedom of movement of the ball in the socket of the multi-axis bearing allows the subassembly housing to rotate in any direction to compensate for the changes in angles caused by the various movements of the vessel. It has been found that a 6:1 ratio between the mass of the inertia mass to mass of the other components of the system which are connected to the ball is particularly advantageous to assure that the antenna rotates in an accurate and stable manner.

In another embodiment, a second subassembly housing may be secured to the top of the multi-axis bearing, opposite the antenna subassembly housing attached to the bottom of the multi-axis bearing. For this embodiment, a double sided stud may be used to secure the antenna sub assemblies together through the multi-axis bearings socket and ball, rather than using a bolt. Also, the upper subassembly housing may be attached upside down and does not have an inertia mass directly attached to it. This configuration allows for two or more antennas to be stabilized with the 6:1 inertia mass ratio in the same manner as described above.

BRIEF DESCRIPTION OF THE DRAWINGS

The accompanying drawings illustrate a preferred embodiment of the invention, and serve to aid in the explanation of the principles of the invention.

DETAILED DESCRIPTION OF THE PREFERRED EMBODIMENT

Figures 1, 2A, 2B:
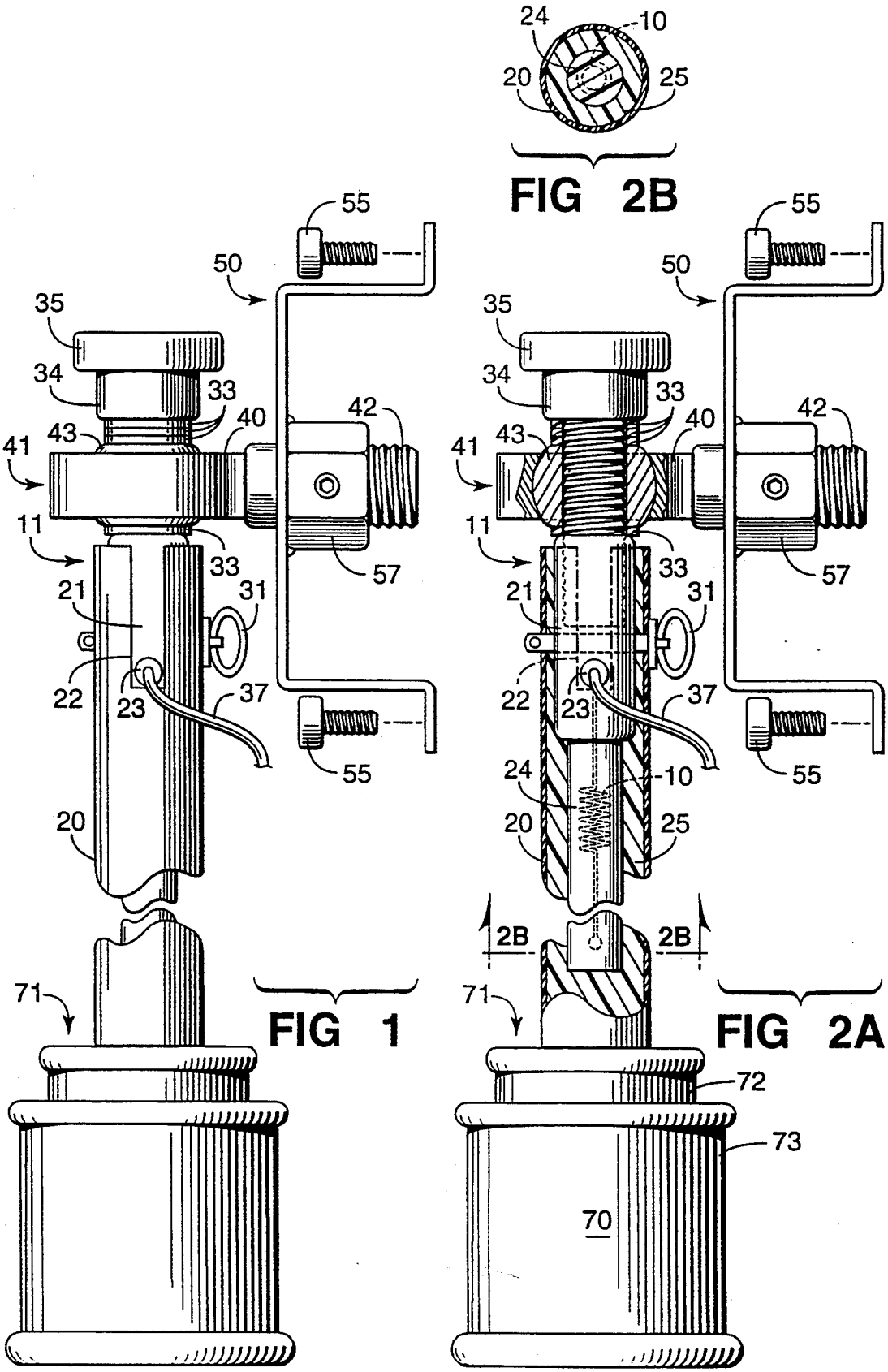
FIG. 1 is a side view of the stabilized mount system.
FIG. 2A is a side view of the stabilized mount system.
FIG. 2B is transverse cross-sectional view of the stabilized mount system taken across line 2B in FIG. 2A.

As shown in FIG. 1, a preferred but nevertheless illustrative embodiment of the stabilized mount system the present invention includes four main components: a subassembly housing 11, a multi-axis bearing 41, an inertia mass 71, and a structural support fixture 50.

Figure 3:
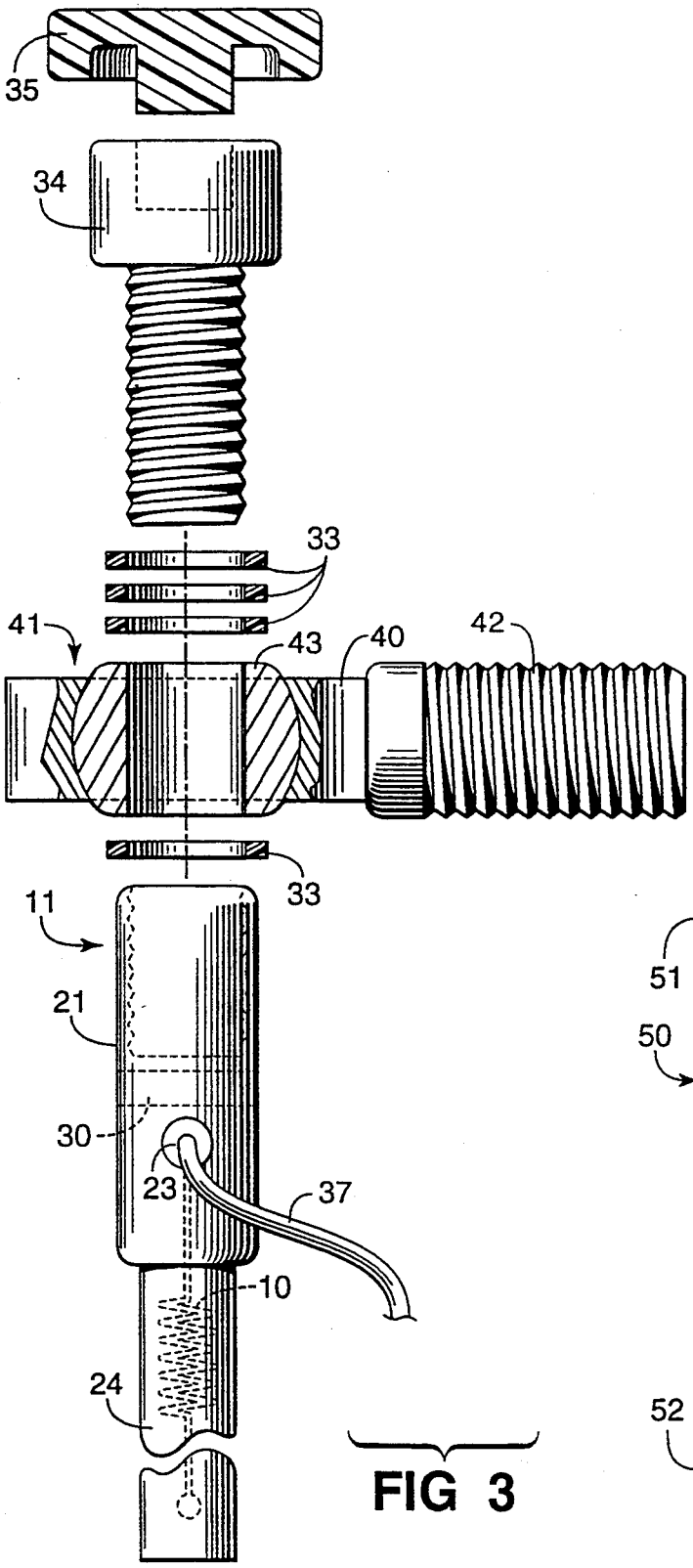
FIG. 3 is a side view of the stabilized mount system with the multi-axis bearing ready for connection with the ferrule portion of the subassembly housing.

The subassembly housing 11 includes three main components, an interior housing 24 (See FIG. 2A and 2B), an exterior housing 20 and a ferrule 21. The interior housing 24 encapsulates an antenna 10 (See FIG. 3), and is preferably made of UV stabilized fiberglass. As best shown in FIG. 3, the ferrule 21 is attached to the top of the interior housing 24. The ferrule 21 is preferably molded of brass and covered with chrome. As best shown in FIG. 2A and B both the interior housing 24 and the ferrule 21 are encompassed by the exterior housing 20. The exterior housing 20 is preferably formed of a high density non-corrosive, hard plastic, such as PVC tubing to provide protection from the elements such as salt spray. Prior to inserting the interior housing 24 and the ferrule 21 into the exterior housing 20, the exterior housing 20 is filled with a radio wave transparent silicon material 25, such as RTV silicon supplied by the General Electric Company, which is inserted in a gel form and allowed to harden to form a water tight bond along the ferrule and adjacent areas.

The exterior housing 20 has a cable spline cutout 22 in its side, and the ferrule 21 has a corresponding hole 23 in its side. When properly aligned, the cable split cutout 22 and the hole 23 allow insertion of a transceiver cable 37 for attaching the antenna 10 to a remote transceiver (not shown). The transceiver cable 37 is a conventional radio frequency low loss electronic cable, which is insulated to meet marine specification standards. The hole 23 in the ferrule 21 is preferably insulated with silicon to prevent elements from the weather from penetrating to the antenna 10.

The exterior housing 20 has a hole on each side (not shown) and the ferrule 21 has a locking pin hole 30. (See FIG. 3) When properly aligned, a locking pin 31, known as a dual ball safety pin, may be inserted in one side of the exterior housing 20, through the ferrule 21, and out the other end of the exterior housing 20. The locking pin 31 preferably has a push pin with balls on the end, which allows for easy insertion and secure locking. The silicon material 25, which partially fills the exterior housing 20, acts as the primary bond for the locking pin 31. Locking the ferrule 21 and the exterior housing 20 together with the locking pin 31 provides added safety to assure the stability of the system. The locking pin 31 also provides a means for transferring the weight of the stabilized mount system away from the fiberglass interior housing 24 to the ferrule 21 and to the hard plastic exterior housing 20.

Figure 5:
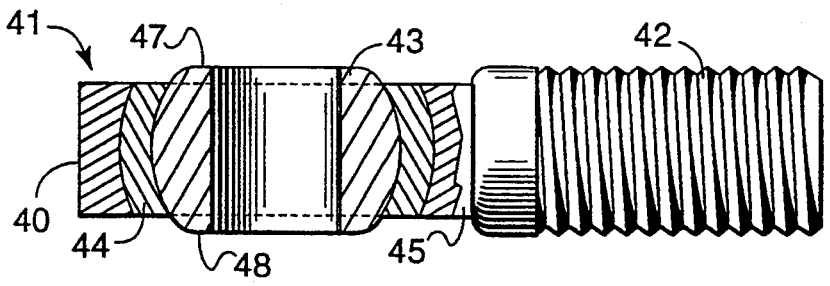
FIG. 5 is cross-sectional view of the multi-axis bearing.
Figure 6:
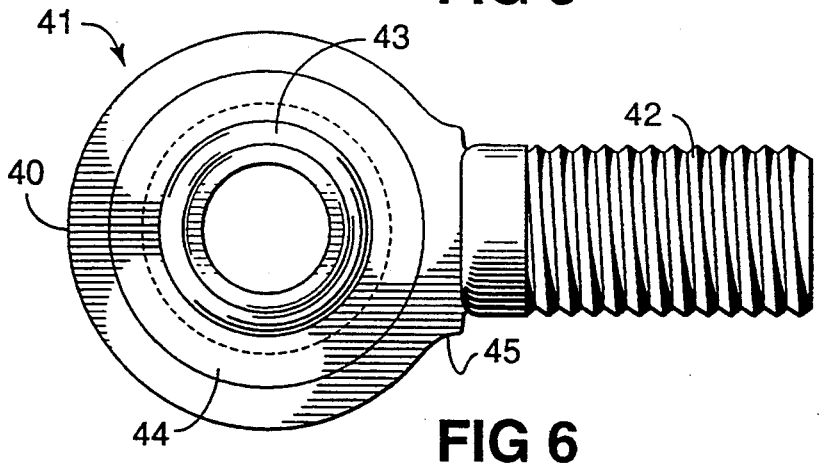
FIG. 6 is an overhead view of the multi-axis bearing.
Figure 7A:
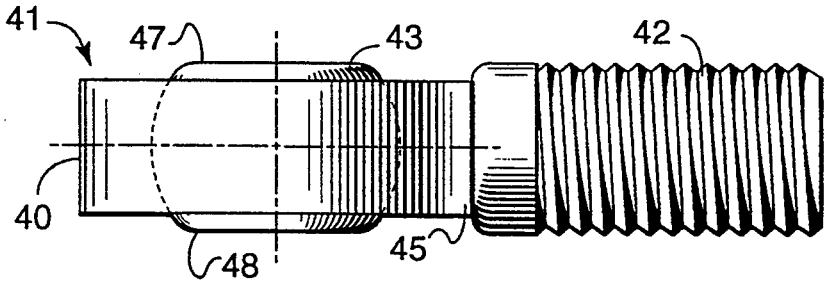
FIG. 7A and 7B are exterior view of the multi-axis bearing showing the rotation of the bearing ball relative to the bearing body.
Figure 7B:
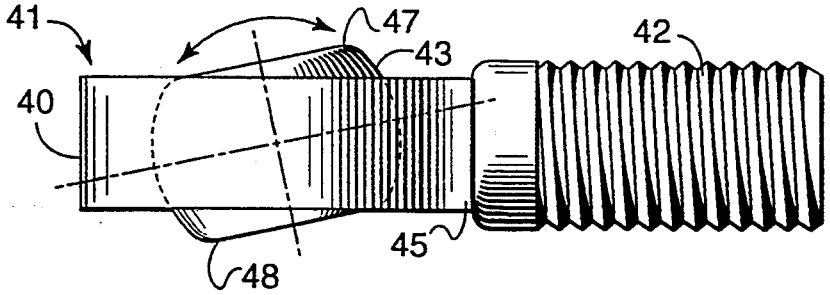

As best shown in FIG. 5 and 6, the multi-axis bearing body 40 includes a socket 44 and a ball 43, inserted into the socket 44 at the head of the multi-axis bearing body 40, and a threaded shaft 42 connected at its neck 45. The multi-axis bearing body 40, such as Aurora's Rod End Bearing, is preferably made of cadmium plated metal. The area that the ball 43 rolls on is made of a self-lubricating teflon. The socket 44 and the ball 43 each have holes through their center and are preferably formed of metal such as stainless steel. As shown in FIG. 7A and 7B, the ball 43 has its top surface 47 and bottom surface 48 cut off so that both surfaces are flat and smooth.

Figure 4A:
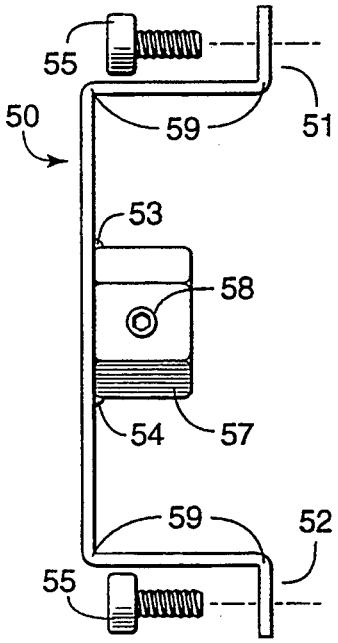
FIG. 4A is a side view of the structural support fixture.
Figure 4B:
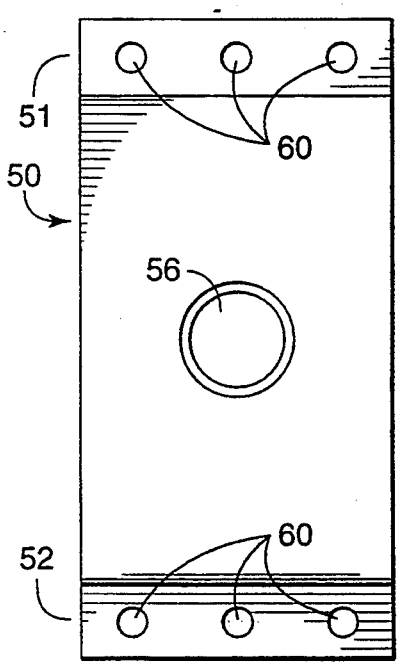
FIG. 4B is a front view of the structural support fixture.

As best shown in FIG. 4A and 4B, the structural support fixture 50 is made up of one piece of metal, preferably 301 half-hard stainless steel. In the preferred embodiment, the support fixture 50 has four crimped right angles 59, but it can be crimped into other configurations to meet the requirements of the surface in which it is to be attached. The top 51 and the bottom 52 of the structural support fixture 50 each have three holes 60, for bolts 55, which allows the fixture 50 to be mounted to the surface of a structure. The center of the structure support fixture 50 has a hole 56, which has the circumference of the multi-axis bearing's threaded shaft 42, and has a nut 57 welded to it with an upper weld 53 and a lower weld 54.

As shown in FIG. 2A, the inertia mass 71 includes a combined upper mass 72 and lower mass 73. Both masses are preferably made of lead and are bonded to reduction/expansion fittings (not shown), which are safety wired with stainless steel wire (not shown). In a top portion of the inertia mass 71 there is a hole, which has the circumference of the exterior housing 20. An inertia mass housing 70 encompasses the inertia mass 71 and acts as a protective covering. It is preferably made of high density plastic such as UV tolerant PVC, and is molded to the inertia mass 71. In a preferred embodiment, the mass of the inertia mass 71 is approximately six times the mass of the stabilized mount system when it is disconnected from the inertia mass 71.

As best shown in FIG. 3, the multi-axis bearing 41, is connected to the subassembly housing 11 with an allen bolt 34, which has a hexagonal head. The allen bolt 34 rests on three nylon bushings 33, which rest on the top surface of the multi-axis bearing ball 43. The bottom surface of the multi-axis bearing ball 43 rests on one nylon bushing 33, which rests on top of the ferrule 21 of the subassembly housing 11. The allen bolt 34 is inserted through the ball 43 (FIG. 6), socket 44 (FIG. 6), and the lower bushing 33, and into the subassembly housing 11. The allen bolt 34 is secured to the subassembly housing 11 by screwing it into the top of the ferrule 21, which is interiorly threaded. A plastic rain shield cap 35 may be snapped onto the head of the allen bolt 34 to protect it from the elements. With the multi-axis bearing body 40 secured to the subassembly housing 11, the rotating ball 43 is able to compensate for the pitch, roll and yaw of the water vessel.

As best shown in FIG. 1, the structural support fixture 50 is attached to the multi-axis bearing shaft 42. The multi-axis bearing shaft 42 is slid through the center hole 56 (FIG. 4) of the structural support fixture 50 and secured in place with a nut 57, which is screwed onto the threaded shaft 42. An allen set screw 58 is screwed into the side of the nut 57, and is used to level the stabilized mount system.

The inertia mass 71 is attached to the subassembly housing 11 by inserting it into the hole in the top of the inertia mass 71. The subassembly housing 11 is then secured into place with epoxy glue.

Figure 8:
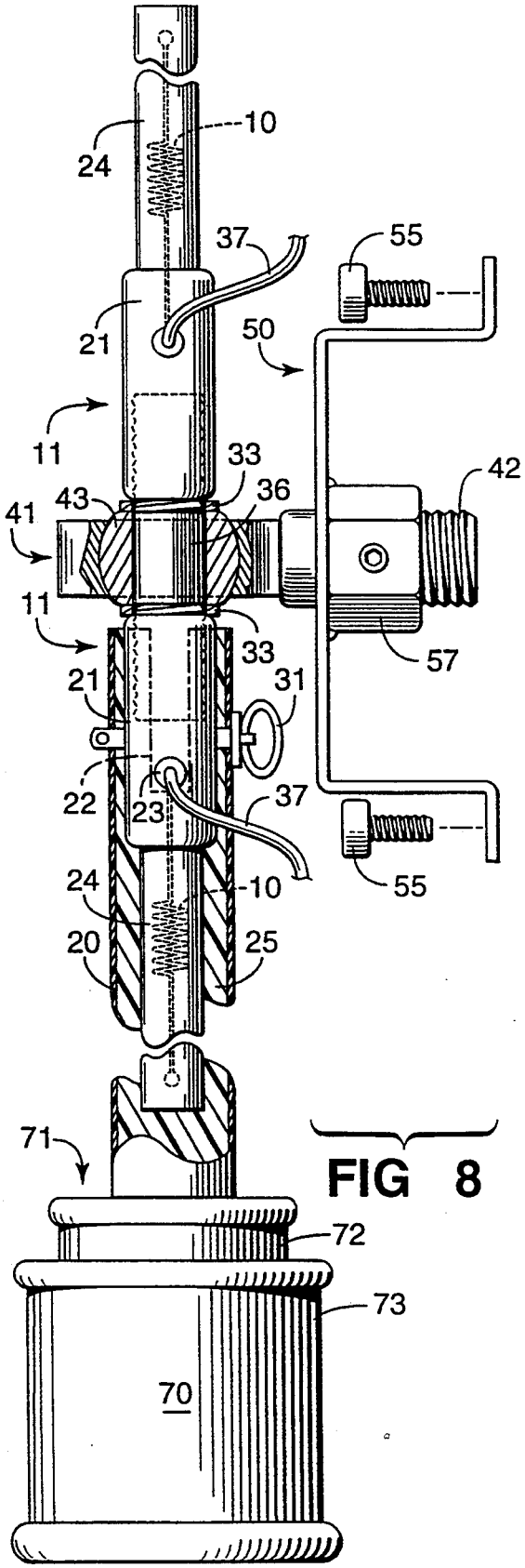
FIG. 8 is a side view of the dual stabilized mount system.

In another embodiment as shown in FIG. 8, a dual stabilized mount system may be configured. This system is similar to the one described in the preferred embodiment but incorporates two subassembly housings 11 by mounting the second subassembly housing 11 upside down to the top surface of the multi-axis bearing body 40. The components of the second subassembly housing 11 are identical to the one described above, except that the upside down subassembly housing 11 does not have a hard plastic exterior housing 20 or a locking pin 31 because it does not have an inertia mass 71 attached to it. Much like the single stabilized mount system, the dual stabilized mount system is stabilized by the inertia mass 71 attached to the bottom subassembly housing 11. Similarly, the mass of the inertia mass 71 remains approximately six times the mass of the entire stabilized mount system with the inertia mass 71 disconnected. Since the top subassembly housing 11 does not have an inertia mass 71 attached to it, then it does not need an exterior housing 20 or a locking pin 31 to transfer the weight away from the interior housing 24.

Figure 9:
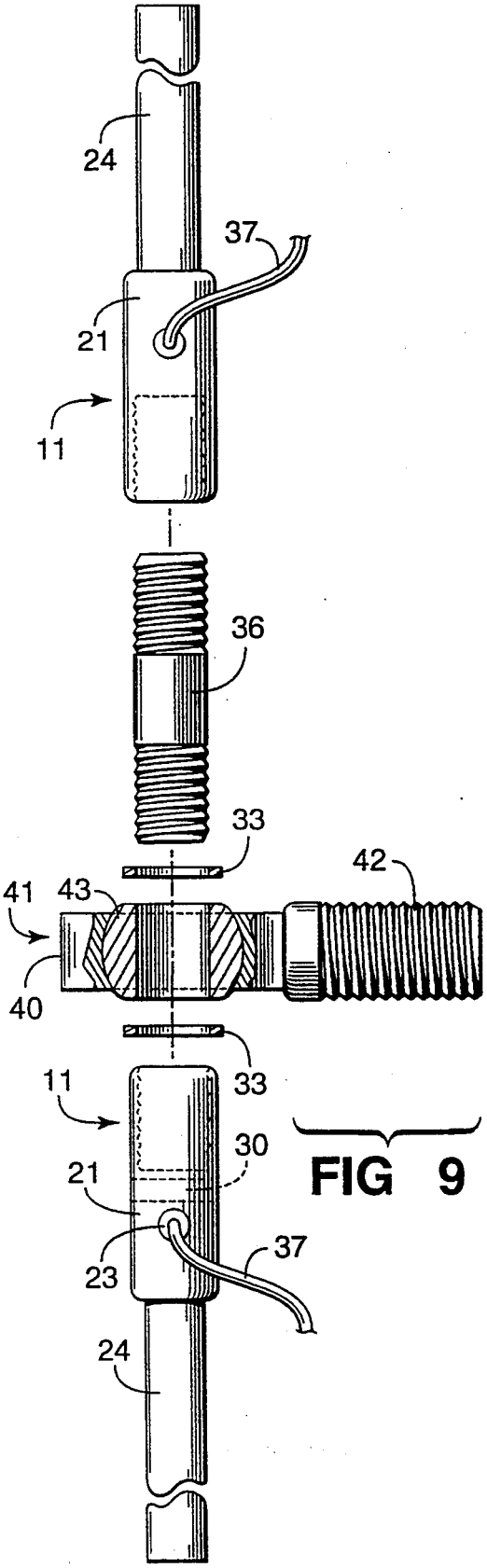
FIG. 9 is a side view of the dual stabilized mount system with the multi axis bearing ready for connection with the ferrule portions of the subassembly housings.
Figure 10:
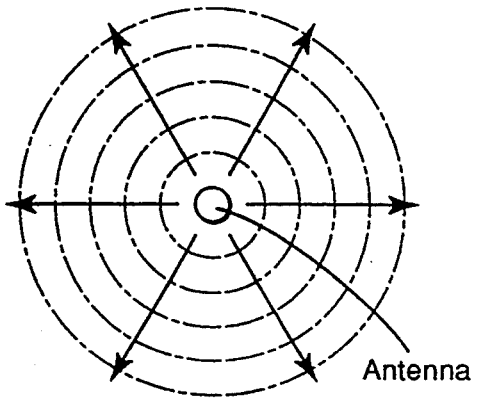
PRIOR ART FIG 10
FIG. 10 is an illustration of the field pattern of a uniform antenna signal emanating from a single source point.
Figure 11:
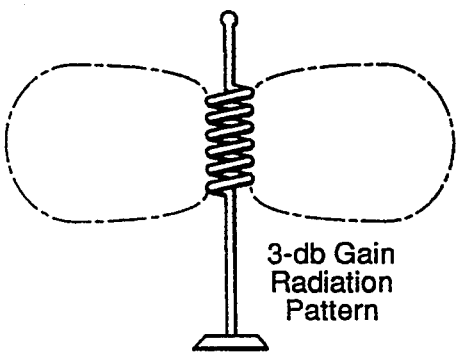
PRIOR ART FIG 11
FIGS. 11 and 12 are illustrations of the field patterns of antenna signals with varying gain emanating from antennas fixedly mounted.
Figure 12:
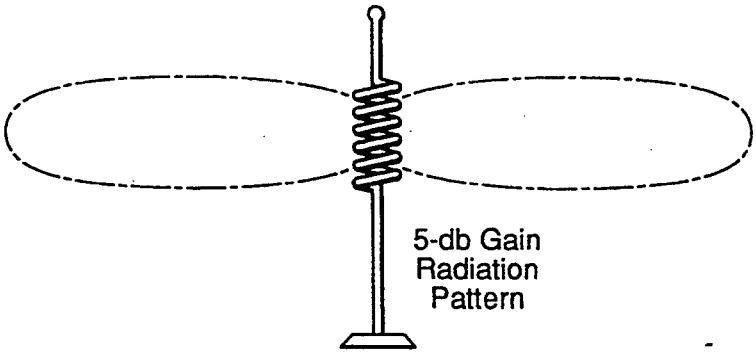
PRIOR ART FIG 12
Figure 13:
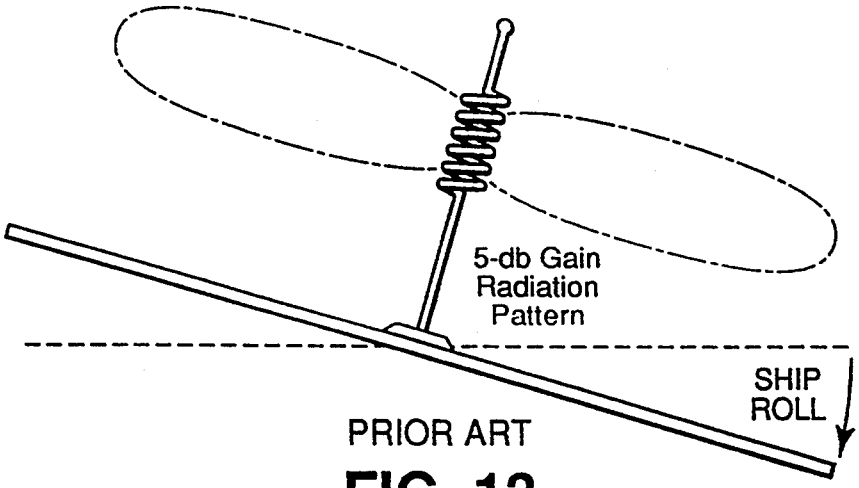
PRIOR ART FIG 13
FIG. 13 is an illustration of an unstable field pattern of a signal emanating from a fixedly mounted antenna.

As best shown in FIG. 9, the subassembly housings 11 are connected together through the multi-axis bearing 40 with a double sided stud 36. The upper assembly housing 11 rests on one nylon bushing 33, which rests on the top surface of the multi-axis bearing ball 43. The bottom surface of the multi-axis bearing ball 43 rests on one nylon bushing 33, which rests on top of the ferrule 21 of the lower subassembly housing 11. The double sided stud 36 is secured to both the upper and the lower subassembly housings 11 by screwing it into the interiorly threaded ferrules 21 of the housings 11.

While a preferred embodiment of the present invention of a shipboard stabilized radio antenna mount system has been illustrated and described, persons skilled in the art will readily appreciate that various additional modifications and embodiments of the invention may be made without departing from the spirit of the invention as defined by the following claims.

We claim

1. A stabilized antenna mount system comprising:

(a) an antenna subassembly including an antenna element;

(b) means coupled to said antenna subassembly for allowing rotation and suspension of said antenna subassembly in three dimensions, wherein said antenna subassembly is suspended from said rotation and suspension allowing means; and (c) means for stabilizing said antenna subassembly including a substantially solid inertia mass connected to a lower portion of said antenna subassembly, wherein said inertia mass responds directly to a gravitational force to urge said antenna subassembly along the axis of the gravitational force, and wherein said inertia mass is the primary means for urging said antenna subassembly along the axis of the gravitational force.

2. The stabilized antenna mount system in accordance with claim 1, wherein said rotation allowing means comprises a multi-axis bearing.

3. The stabilized antenna mount system in accordance with claim 2, wherein said multi-axis bearing comprises:

a body having a socket formed therein; and a ball-like object partially enclosed in said socket and having a substantially flat top portion, a substantially flat bottom portion and a cylindrical hole through said ball-like object joining a center portion of said top portion and a center portion of said bottom portion.

4. The stabilized antenna mount system in accordance with claim 1, wherein said inertia mass is approximately six times the sum of the mass of the antenna subsassembly and the mass of the rotation allowing means.

5. The stabilizer antenna mount system in accordance with claim 1, wherein said substantially solid inertia mass is formed of a metallic material covered by a moisture-resistant material.

6. The stabilized antenna mount system in accordance with claim 1, wherein said antenna subassembly comprises:

an antenna housing; and an interior housing enclosed in said antenna housing and adapted to enclose said antenna element.

7. The stabilized antenna mount system in accordance with claim 6, wherein said antenna housing is formed of a hard plastic material and has a cutout spline thereon for allowing passage therethrough of an antenna cable to an antenna cable outlet in said interior housing.

8. The stabilized antenna mount system in accordance with claim 6, wherein said antenna subassembly further comprises a means for transferring a gravitational force, associated with said inertia mass, away from said interior housing by coupling said inertia, mass to said antenna housing.

9. The system in accordance with claim 8, wherein said mass transferring means comprises:

a ferrule connected to a portion of said rotation allowing means, wherein said ferrule is inserted in a top portion of said antenna housing in sliding relationship; and a lock pin adapted to connect said ferrule to said antenna housing.

10. The stabilized antenna mount system in accordance with claim 1, further comprising a second antenna subassembly connected to a top portion of said antenna subassembly.

11. The stabilized antenna mount system in accordance with claim 1, wherein said inertia mass comprises a lead composition.

12. The stabilized antenna mount system in accordance with claim 1, wherein said inertia mass further includes a protective covering.

13. The stabilized antenna mount system in accordance with claim 1, wherein said antenna subassembly is freely moveable relative to said rotation allowing means.

14. The stabilized antenna mount system in accordance with claim 1, wherein said antenna subassembly remains substantially perpendicular to the surface of the earth.

15. A stabilized antenna mount system comprising:

(a) a substantially linear antenna subassembly including an antenna element, wherein the length of the antenna subassembly is substantially greater than the width;

(b) means coupled to said antenna subassembly for allowing rotation and suspension of said antenna subassembly in three dimensions, wherein said antenna subassembly is suspended from said rotation and suspension allowing means; and (c) means for stabilizing said antenna subsassembly including an inertia mass connected to a lower portion of said antenna subassembly, wherein said inertia mass lies along the linear axis of said substantially linear antenna subassembly.

16. The stabilized antenna mount system in accordance with claim 15, wherein said inertia mass is substantially solid.

17. The stabilized antenna mount system in accordance with claim 15, wherein said rotation allowing means comprises a multi-axis bearing.

18. The stabilized antenna mount system in accordance with claim 11, wherein said multi-axis bearing comprises:

a body having a socket formed therein; and a ball-like object partially enclosed in said socket and having a substantially flat top portion, a substantially flat bottom portion and a cylindrical hole through said ball-like object joining a center portion of said top portion and a center portion of said bottom portion.

19. The stabilized antenna mount system in accordance with claim 15, wherein said inertia mass is approximately six times the sum of the mass of the antenna subassembly and the mass of the rotation allowing means.

20. The stabilized antenna mount system in accordance with claim 15, wherein said inertia mass is formed of a metallic material covered by a moisture-resistant material.

21. The stabilized antenna mount system in accordance with claim 15, wherein said antenna subassembly comprises:

an antenna housing; and an interior housing enclosed in said antenna housing and adapted to enclose said antenna element.

22. The stabilized antenna mount system in accordance with claim 21, wherein said antenna housing is formed of a hard plastic material and has a cutout spline thereon for allowing passage therethrough of an antenna cable to an antenna cable outlet in said interior housing.

23. The stabilized antenna mount system in accordance with claim 15, further comprising a second antenna subassembly connected to a top portion of said antenna subassembly.

24. The stabilized antenna mount system in accordance with claim 15, wherein said inertia mass comprises a lead composition.

25. The stabilized antenna mount system in accordance with claim 15, wherein said inertia mass further comprises a protective covering.

26. The stabilized antenna mount system in accordance with claim 15, wherein said inertia mass responds directly to a gravitational force to urge said antenna subassembly along the axis of the gravitational force.

27. The stabilized antenna mount system in accordance with claim 15, wherein said antenna subassembly is freely moveable relative to said rotation allowing means.

28. The stabilized antenna mount system in accordance with claim 15, wherein said antenna subassembly remains substantially perpendicular to the surface of the earth.

* * * * *